US009470443B2

(12) United States Patent
Brown et al.

(10) Patent No.: US 9,470,443 B2
(45) Date of Patent: Oct. 18, 2016

(54) MODIFIED HOSE FLUSH DEVICE AND METHOD

(71) Applicant: Service Solutions U.S. LLC, Warren, MI (US)

(72) Inventors: William Brown, Owatonna, MN (US); Mark McMasters, Owatonna, MN (US); Dylan Lundberg, Lonsdale, MN (US)

(73) Assignee: Bosch Automotive Service Solutions Inc., Warren, MI (US)

( * ) Notice: Subject to any disclaimer, the term of this patent is extended or adjusted under 35 U.S.C. 154(b) by 811 days.

(21) Appl. No.: 13/827,316

(22) Filed: Mar. 14, 2013

(65) Prior Publication Data

US 2014/0260353 A1 Sep. 18, 2014

(51) Int. Cl.
*F25B 45/00* (2006.01)

(52) U.S. Cl.
CPC ..... *F25B 45/00* (2013.01); *F25B 2345/001* (2013.01); *F25B 2345/002* (2013.01); *F25B 2345/003* (2013.01); *F25B 2345/005* (2013.01); *F25B 2345/006* (2013.01)

(58) Field of Classification Search
CPC ..... B60H 1/00585; F25B 45/00; F25B 2345/002; F25B 2345/005; F25B 2345/0052; F25B 2345/006; F25B 2345/001
See application file for complete search history.

(56) References Cited

U.S. PATENT DOCUMENTS

| | | | | |
|---|---|---|---|---|
| 5,168,720 | A | 12/1992 | Keltner | |
| 5,218,831 | A | 6/1993 | Keltner | |
| 7,854,130 | B2 | 12/2010 | Brown et al. | |
| 2009/0188263 | A1 * | 7/2009 | Murray | B60H 1/00585 62/77 |
| 2013/0014520 | A1 | 1/2013 | Murray et al. | |

FOREIGN PATENT DOCUMENTS

| | | | |
|---|---|---|---|
| WO | 2011088831 | A | 7/2011 |

OTHER PUBLICATIONS

International Search Report dated Aug. 19, 2014 for PCT/US2014/027824 filed Mar. 14, 2014.

* cited by examiner

*Primary Examiner* — Cassey D Bauer
(74) *Attorney, Agent, or Firm* — Baker Hostetler LLP

(57) ABSTRACT

A refrigerant recovery system includes a refrigerant storage unit, a refrigerant charge path, a flushing path, a processor, and a memory. The refrigerant storage unit is configured to store a refrigerant. The refrigerant charge path is configured to convey the refrigerant to a refrigeration system to recharge the refrigeration system with the refrigerant. The refrigerant charge path includes a first and second service coupler and a first and second service hose. The service hoses are in fluid communication with the respective service couplers. The flushing path is configured to receive a flow of refrigerant for flushing the refrigeration charge path. The flushing path includes a first and second flushing coupler. The processor is configured to control the refrigerant recovery system to provide a flow of the refrigerant from the storage unit, through the refrigerant charge path, and to the flushing path.

18 Claims, 5 Drawing Sheets

MODIFIED HOSE FLUSH DEVICE AND METHOD

FIELD OF THE INVENTION

The disclosure generally relates to a refrigerant recovery unit. More particularly, the disclosure relates to an improved hose flush path and method for the refrigerant recovery unit.

BACKGROUND OF THE INVENTION

Portable refrigerant recovery units or carts are used in connection with the service and maintenance of refrigeration systems, such as a vehicle's air conditioning system. The refrigerant recovery unit connects to the air conditioning system of the vehicle to recover refrigerant out of the system, separate out oil and contaminants from the refrigerant in order to recycle the refrigerant, and recharge the system with additional refrigerant.

New refrigeration systems generally utilize newer types of refrigerants while older systems typically utilize older types of refrigerants. Unfortunately, these newer and older refrigerants are generally incompatible and, furthermore, the respective oils are incompatible as well. As such, the refrigerant recovery unit is thoroughly flushed before transitioning from servicing a refrigeration system with one type of refrigerant to servicing a refrigeration system with another type of refrigerant. However, due to the difficulties in flushing oils from the service hoses, the flushing procedure is time consuming and can potentially lead to contamination of the refrigeration system.

Accordingly, it is desirable to provide a device and method capable of overcoming the disadvantages described herein at least to some extent.

SUMMARY OF THE INVENTION

The foregoing needs are met, to a great extent, by the present invention, wherein in one respect an improved flushing device and method for a refrigerant recovery unit is provided.

An embodiment of the present invention pertains to a refrigerant recovery system. The refrigerant recovery system includes a refrigerant storage unit, a refrigerant charge path, a flushing path, a processor, and a memory. The refrigerant storage unit is configured to store a refrigerant. The refrigerant charge path is configured to convey the refrigerant to a refrigeration system to recharge the refrigeration system with the refrigerant. The refrigerant charge path includes a first service coupler, a first service hose, a second service couple, and a second service hose. The first service coupler is disposed at a high side of the refrigeration charge path. The first service hose is in fluid communication with the first service coupler. The second service coupler is disposed at a low side of the refrigeration charge path. The second service hose is in fluid communication with the second service coupler. The flushing path is configured to receive a flow of refrigerant for flushing the refrigeration charge path. The flushing path includes a first flushing coupler and a second flushing coupler. The first flushing coupler is in fluid communication with the first service hose. The second flushing coupler is in fluid communication with the second service hose. The processor is configured to control the refrigerant recovery system to provide a flow of the refrigerant from the storage unit, through the refrigerant charge path, and to the flushing path. The memory is to store diagnostic software and operating software to operate the refrigerant recovery system.

Another embodiment of the present invention relates to a refrigerant recovery unit. The refrigerant recovery unit includes a refrigerant storage unit, a refrigerant charge path, a flushing path a processor, and a memory. The refrigerant storage unit is configured to store a refrigerant. The refrigerant charge path is configured to convey the refrigerant to a refrigeration system to recharge the refrigeration system with the refrigerant. The refrigerant charge path includes a first service coupler and a second service coupler. The first service coupler is disposed at a high side of the refrigeration charge path. The second service coupler is disposed at a low side of the refrigeration charge path. The flushing path is configured to receive a flow of refrigerant for flushing the refrigeration charge path. The flushing path includes a first flushing coupler and a second flushing coupler. The first flushing coupler is in fluid communication with the first service coupler. The second flushing coupler is in fluid communication with the second service coupler. The processor is configured to control the refrigerant recovery unit to provide a flow of the refrigerant from the storage unit, through the refrigerant charge path, and to the flushing path. The memory is to store diagnostic software and operating software to operate the refrigerant recovery unit.

Yet another embodiment of the present invention pertains to a refrigerant recovery unit. The refrigerant recovery unit includes a refrigerant storage unit, a refrigerant charge path, a flushing path, a processor, and a memory. The refrigerant storage unit is configured to store a refrigerant. The refrigerant charge path is configured to convey the refrigerant to a refrigeration system to recharge the refrigeration system with the refrigerant. The refrigerant charge path includes a single controllable valve, a first service coupler, and a second service coupler. The single controllable valve is disposed between the refrigerant storage unit and the refrigerant charge path. The first service coupler is disposed at a high side of the refrigeration charge path. The second service coupler is disposed at a low side of the refrigeration charge path. The flushing path is configured to receive a flow of refrigerant for flushing the refrigeration charge path. The flushing path includes a first flushing coupler and a second flushing coupler. The first flushing coupler is in fluid communication with the first service coupler. The second flushing coupler is in fluid communication with the second service coupler. The processor is configured to control the single controllable valve to provide a flow of the refrigerant from the storage unit, through the refrigerant charge path, and to the flushing path. The memory is to store diagnostic software and operating software to operate the refrigerant recovery unit.

Yet another embodiment of the present invention relates to a method of flushing a refrigeration recovery system. In this method, a refrigerant charge path is fluidly connected to a first service hose. The refrigerant charge path is fluidly connected to a second service hose. The first service hose is fluidly connected to a first flushing coupler of a flushing path. The second service hose is fluidly connected to a second flushing coupler of the flushing path. A valve is controlled with a processor in the refrigerant recovery system to provide a flow of a refrigerant to flush the charge path, the first service hose, and the second service hose. The refrigerant is collected from the flushing path in the refrigerant recovery system.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

According to various embodiments described herein, a refrigerant recovery unit is provided that facilitates the servicing of a refrigeration system. As used herein, the term, "servicing" refers to any suitable procedure performed on a refrigeration or air conditioning system such as, for example, recovering refrigerant, recharging refrigerant into the refrigeration system, testing refrigerant, leak testing the refrigeration system, recovering the lubricant, replacing the lubricant, and the like. An embodiment of the refrigerant recovery unit disclosed herein may be used to improve the flushing of service hoses and the refrigeration recovery unit utilized in the servicing of an air conditioning system or other refrigeration system. In this or other embodiments, the refrigerant recovery unit described herein may facilitate improved flushing of the service hoses by providing flushing ports for the service hoses and controlling refrigerant recovery unit to conduct an improved flushing procedure. This improved flushing procedure is particularly beneficial to perform when transitioning from servicing a refrigeration system with one refrigerant to a refrigeration system with another refrigerant. In this regard, different refrigerants for air conditioning systems are generally incompatible as are their respective oils or lubricants. During servicing, the refrigerant and lubricant from the air conditioning system come in contact with and adhere to the inside of the service hoses and components of the refrigerant recovery unit. If the refrigerant and lubricant are not removed, it may contaminate a subsequent refrigeration system having a different refrigerant and/or lubricant.

Figure 1:
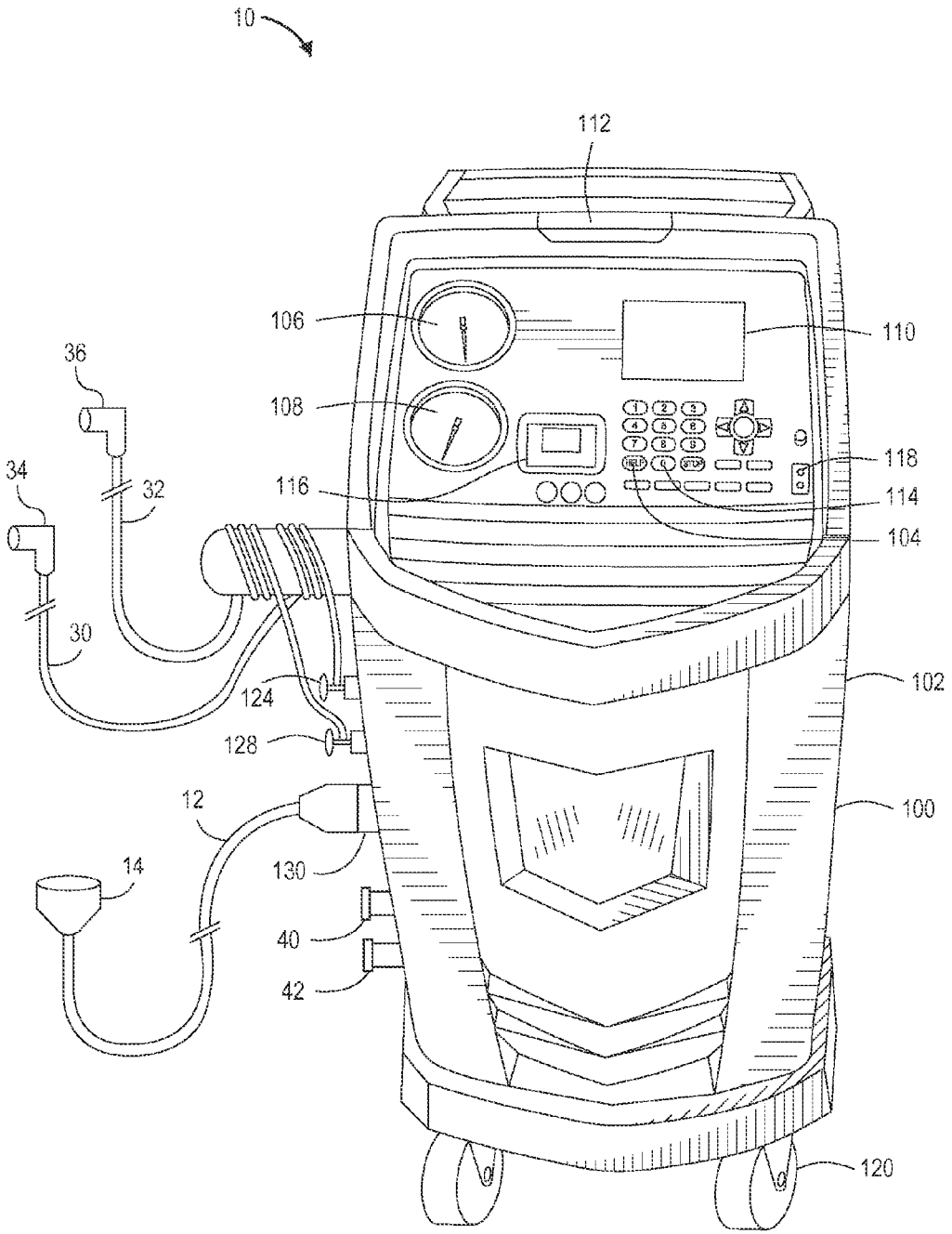
FIG. 1 is a perspective view of a refrigerant recovery unit in accordance with an embodiment of the disclosure.

As shown in FIG. 1, a refrigerant recovery system 10 includes a refrigerant recovery unit 100 and a communication cable 12 with a connector 14. The connector 14 is configured to conform to any suitable communication standards or protocols. Examples of suitable communication standards include on-board diagnostics (OBD) and OBDII, J1850 (variable pulse width (VPW) and pulse-width modulation (PWM)), international organization for standards (ISO) 9141-2 signal, communication collision detection (CCD) (e.g., Chrysler collision detection), data communication links (DCL), serial communication interface (SCI), Controller Area Network (CAN), Keyword 2000 (ISO 14230-4), OBD II or other communication protocols. According to various embodiments, the connector 14 is configured to convey any suitable data/command control information.

Figure 2:
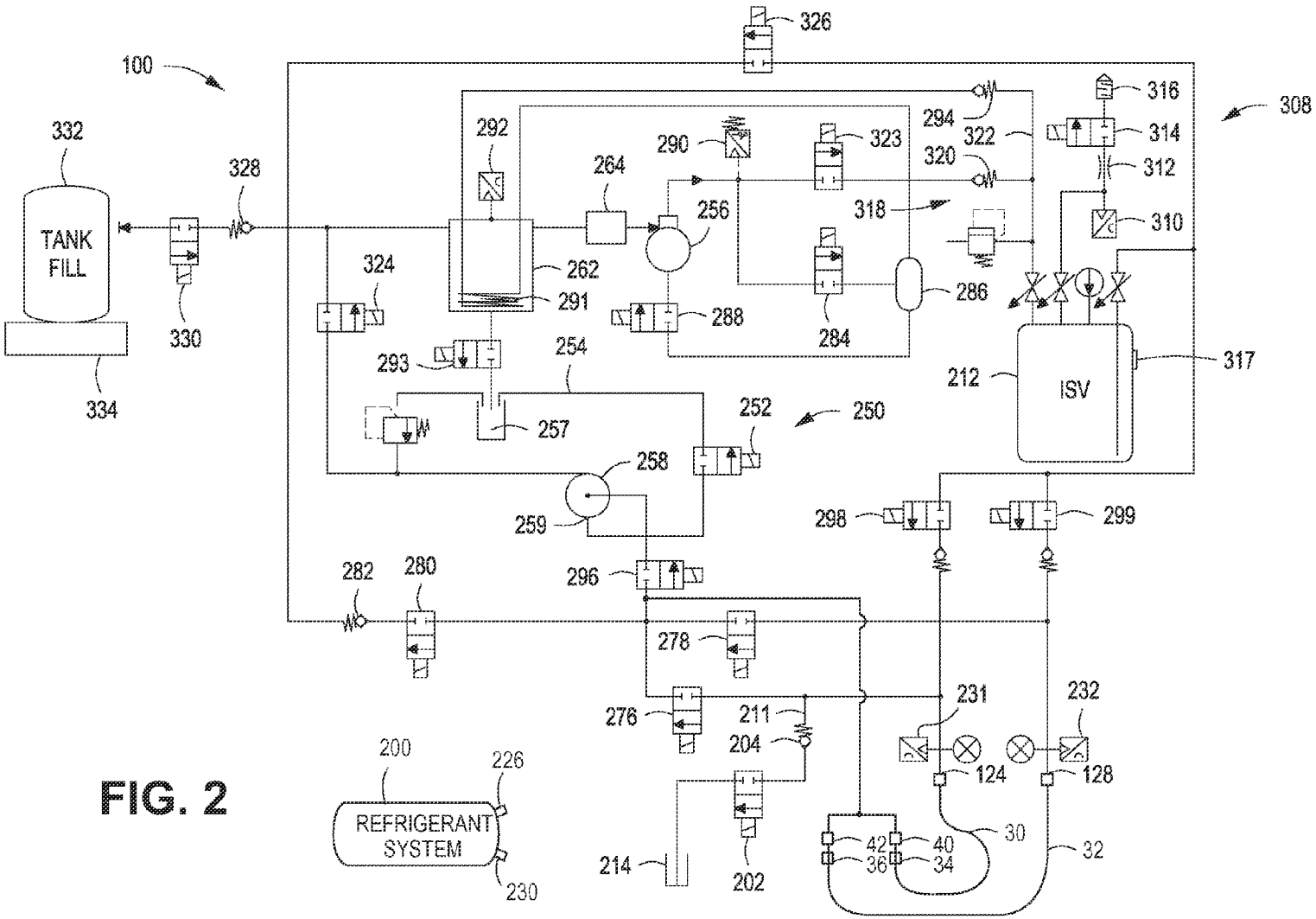
FIG. 2 is a schematic diagram illustrating components of the refrigerant recovery unit shown in FIG. 1.

Also shown in FIG. 1, the refrigerant recovery system 10 optionally includes a pair of service hoses 30 and 32, each with a respective service coupler 34 and 36 to connect the refrigerant recovery unit 100 to a refrigeration system (shown in FIG. 2). In various embodiments, the refrigeration system may be a standalone unit and/or disposed within a vehicle, device, appliance, structure, or the like. A vehicle can be any suitable vehicle, such as an automobile, train, airplane, boat, ship and the like. Suitable devices or appliances may include, for example, an air conditioning unit, dehumidifier, ice maker, refrigerator/freezer, beverage dispenser, ice cream maker, and the like.

The refrigerant recovery unit 100 includes a pair of flushing couplers 40 and 42. As described herein, the flushing couplers 40 and 42 are configured to mate with the service couplers 34 and 36 to fluidly connect the service hoses 30 and 32 to a vacuum source. In use, the flushing couplers 40 and 42 complete a flushing loop from the refrigerant recovery unit 100, through the service hoses 30 and 32, and back into the refrigerant recovery unit 100. This flushing loop is described in greater detail herein.

The refrigerant recovery unit 100 can be the AC1234™ from ROBINAIR® based in Owatonna, Minn. (Service Solutions U.S., LLC). The refrigerant recovery unit 100 includes a cabinet 102 to house components of the unit (See FIG. 2). The cabinet 102 may be made of any suitable material such as thermoplastic, steel and the like.

The cabinet 102 includes a control panel 104 that allows the user to operate the refrigerant recovery unit 100. The control panel 104 may be part of the cabinet as shown in FIG. 1 or separated. The control panel 104 includes high and low gauges 106, 108, respectively. For the purposes of this disclosure, the terms, "high" and "low" generally refer to the high and low pressure sides of a refrigeration system, respectively. The gauges may be analog or digital. The control panel 104 has a display 110 to provide information to a user. The information may include, for example, operating status of the refrigerant recovery unit 100 or provide messages or menus to the user. The control panel 104 may include indicators 112 to indicate to the user the operational status of the refrigerant recovery unit 100, progress of a flushing operation, and the like. If included, the indicators 112 may include light emitting diodes (LEDs) or the like, that when activated, may indicate that the refrigerant recovery unit 100 is in the recovery, recycling or recharging mode or indicate that the filter needs to be changed or that there is a malfunction.

According to an embodiment, the control panel 104 includes a user interface 114 to provide the user with an interface to interact and operate the refrigerant recovery unit 100. The user interface 114 may include any suitable interface such as, for example, an alphanumeric keypad, directional arrows, function keys, pressure or touch sensitive display, and the like. Optionally, a printer 116 is provided to print out information, such as test results.

The cabinet 102 further includes a pair of service couplers 124, 128 that connect the service hoses 30, 32, respectively, to the refrigerant recovery unit 100. Also shown in FIG. 1, a vehicle connector interface 130 is provided so that the communication cable 12 can be connected from the vehicle connector interface 130 to a data link connector in a vehicle (not shown in FIG. 1). This allows the refrigerant recovery unit 100 to communicate with the vehicle and access various controllers in the vehicle and/or diagnose any issues with the vehicle and its subsystems. In order for the refrigerant recovery unit 100 to be mobile, one or more wheels 120 are provided at a bottom portion of the cabinet 102.

During servicing of a refrigeration system 200 (shown in FIG. 2), the service hoses 30 and 32 are typically connected to the refrigeration system 200 and the connector 14 is typically connected to a controller associated with the refrigeration system 200. In operation, the refrigerant recovery system 10 is utilized to collect refrigerant from the refrigeration system 200. For example, one or both of the service hoses 30 and 32 may be connected to the refrigeration system 200 and the refrigerant recovery system 10 is configured to receive or draw out the refrigerant from the refrigeration system 200 and then condense the refrigerant being recovered from the refrigeration system 200. Once the refrigerant has been recovered from the refrigeration system, the refrigeration system 200 may be recharged. For example, one or both of the service hoses 30 and 32 may be utilized to deliver a suitable amount of a suitable refrigerant from the refrigerant recovery system 10 to the refrigeration system 200.

Prior to the recharging procedure, the service hoses 30 and 32 may be disconnected to the refrigeration system 200 and then connected to the flushing couplers 40 and 42. More particularly, the service coupler 34 is coupled to the flushing coupler 40 and/or the service coupler 36 is coupled to the flushing coupler 42. In an example, both the service couplers 34 and 36 are coupled to one of the flushing couplers 40 and 42 so that both service hoses 30 and 32 may be flushed at the same time. In other examples, one or the other of the service couplers 34 and 36 are coupled to one of the flushing couplers 40 and 42 so that the service hoses 30 and 32 may be selectively flushed one at a time. Of note, in general, 'high' and 'low' side service couplers are not interchangeable. However, functionally, the service coupler 34 may be coupled to either the flushing couplers 40 or 42 and the service coupler 36 may be coupled to either the flushing couplers 40 or 42.

FIG. 2 illustrates components of the refrigerant recovery system 10 of FIG. 1 according to an embodiment of the present disclosure. In general, the refrigerant recovery system 10 is configured to facilitate testing, removing, and recharging refrigerant and/or lubricant in a refrigeration system 200. In addition, the refrigerant recovery system 10 may be configured to purify some types of contaminants from refrigerant recovered from the refrigeration system 200. Furthermore, the refrigerant recovery system 10 is configured to flush refrigerant and/or lubricant from the service hoses 30 and 32 and internal workings of the refrigerant recovery unit 100. More particularly, embodiments described herein facilitate a flushing procedure that may be performed more quickly, reduces cross contamination of high and low side components, and/or the like.

In this or other embodiments, the refrigerant recovery system 10 may be flush prior to and/or following servicing of the refrigeration system 200. In this manner, contamination of the refrigeration system 200 and/or other refrigeration systems serviced by the refrigerant recovery system 10 may be reduced. In the particular example shown, the refrigerant recovery system 10 is configured to perform a flush cycle. Specifically, the service hoses 30 and 32 are shown fluidly connecting the service couplers 124 and 128 to the flushing couplers 40 and 42.

In preparation for initiating the flush cycle, an air intake valve (not shown) is opened, allowing the vacuum pump 258 to start exhausting air. The air intake valve is then closed and the flush cycle begins by opening the valve 296, leading to the input of a vacuum pump 258. The service hoses 30 and 32 and lines leading to the service hoses 30 and 32 are then evacuated by opening the valve 296, allowing the vacuum pump 258 to exhaust any trace gases remaining until the pressure is approximately 29 inches of mercury, for example. When this occurs, as detected by a plurality of optional pressure transducers 231 and 232, the controller 216 is configured to receive the signals via wired or wireless connection from the pressure transducers 231 and 232. In response, the controller 216 is configured to open charge valves 298 and 299 to allow the refrigerant in a storage tank 212, which is at a pressure of approximately 70 psi or above, to flow through the service hoses 30 and 32 and lines leading to the service hoses 30 and 32. The flow through charge valves 298 and 299 is performed for a predetermined flush time programmed to provide a thorough flush of the service hoses 30 and 32 and lines leading to the service hoses 30 and 32. Any lubricant present in the flushed refrigerant is removed via the system oil separator 262 and deposited in the container 257 via valve 293. The flushed refrigerant is dried via the filter/dryer 264, compressed via the compressor 256, condensed via the heat exchanger 291, and returned to the storage tank 212. The storage tank 212 may be disposed on a scale (not shown) that measures the weight of the refrigerant in the storage tank 212. The storage tank 212 is configured to store the refrigerant that has been filtered, dehydrated, and had the lubrication removed by the various other components of the refrigerant recovery unit 100. As such, the refrigerant in the storage tank 212 is substantially free of water and/or lubricant. For the purposes of this disclosure, the term, "substantially free of water and/or lubricant" means that most of any lubricant or water present has been removed. For example, the refrigerant may be about 99% to 99.99% pure refrigerant and less than 0.01 to 1% lubricant and/or water total.

Prior to recovering refrigerant from the refrigerant system 200, the service hoses 30 and 32 are coupled to the refrigeration system 200 of the vehicle, via couplers 226 (high side) and 230 (low side), respectively. The couplers are designed to be closed until they are coupled to the refrigerant system 200.

The recovery cycle is initiated by the opening of high pressure and low-pressure solenoids 276, 278, respectively. This allows the refrigerant within the vehicle's refrigeration system 200 to flow through a recovery valve 280 and a check valve 282. The refrigerant flows from the check valve 282 into a system oil separator 262, where it travels through a filter/dryer 264, to an input of a compressor 256. Refrigerant is drawn through the compressor 256 through a normal discharge solenoid 284 and through a compressor oil separator 286, which circulates oil back to the compressor 256 through an oil return valve 288. The refrigerant recovery unit 100 may include a high-pressure switch 290 in communication with a controller 216, which is programmed to determine an upper pressure limit, for example, 435 psi, to optionally shut down the compressor 256 to protect the compressor 256 from excessive pressure. The controller 216 can also be, for example, a microprocessor, a field programmable gate array (FPGA) or application-specific integrated circuit (ASIC). The controller 216 via a wired or wireless connection (not shown) controls the various valves and other components (e.g. vacuum, compressor) of the refrigerant recovery unit 100. In some embodiments of the present disclosure, any or all of the electronic solenoid or electrically activated valves may be connected and controlled by the controller 216.

A high-side clear solenoid 323 may optionally be coupled to the output of the compressor 256 to release the recovered refrigerant transferred from compressor 256 directly into a storage tank 212, instead of through a path through the normal discharge solenoid 284.

The heated compressed refrigerant exits the oil separator 286 and then travels through a loop of conduit or heat exchanger 291 for cooling or condensing. As the heated refrigerant flows through the heat exchanger 291, the heated refrigerant gives off heat to the cold refrigerant in the system oil separator 262, and assists in maintaining the temperature in the system oil separator 262 within a working range. Coupled to the system oil separator 262 is a switch or transducer 292, such as a low pressure switch or pressure transducer, for example, that senses pressure information, and provides an output signal to the controller 216 through a suitable interface circuit programmed to detect when the pressure of the recovered refrigerant is down to 13 inches of mercury, for example. An oil separator drain valve 293 drains the recovered oil into a container 257. Finally, the recovered refrigerant flows through a normal discharge check valve 294 and into the storage tank 212.

The evacuation cycle begins by the opening of high pressure and low-pressure solenoids 276 and 278 and valve 296, leading to the input of a vacuum pump 258. Prior to opening valve 296, an air intake valve (not shown) is opened, allowing the vacuum pump 258 to start exhausting air. The vehicle's refrigerant system 200 is then evacuated by the closing of the air intake valve and opening the valve 296, allowing the vacuum pump 258 to exhaust any trace gases remaining until the pressure is approximately 29 inches of mercury, for example. When this occurs, as detected by pressure transducers 231 and 232, optionally, coupled to the high side 226 and low side 230 of the vehicle's refrigeration system 200 and to the controller 216, the controller 216 turns off valve 296 and this begins the recharging cycle.

The recharging cycle begins by opening charge valve 298 to allow the refrigerant in storage tank 212, which is at a pressure of approximately 70 psi or above, to flow through the high side of the vehicle's refrigeration system 200. The flow is through charge valve 298 for a period of time programmed to provide a full charge of refrigerant to the vehicle. Optionally, charge valve 299 may be opened to charge the low side. The charge valve 299 may be opened alone or in conjunction with charge valve 298 to charge the vehicle's refrigerant system 200. The storage tank 212 may be disposed on a scale (not shown) that measures the weight of the refrigerant in the storage tank. In an embodiment, the flushing cycle described herein is performed to clean the service hoses 30 and 32 and the lines leading from the service hoses 30 and 32 following the recharging cycle.

Other components shown in FIG. 2 include an oil inject circuit having an oil inject valve 202 and an oil inject hose or line 211. The oil inject hose 211 is one example of a fluid transportation means for transmitting oil for the refrigerant recovery unit 100. The oil inject hose 211 may be one length of hose or multiple lengths of hose or tubing or any other suitable means for transporting fluid. The oil inject hose 211 connects on one end to an oil inject bottle 214 and on the other end couples to the refrigerant circuit in the refrigerant recovery unit 100. Disposed along the length of the oil inject hose 211 are the oil inject valve 202 and an oil check valve 204. The oil inject path follows from the oil inject bottle 214, through the oil inject solenoid 202, to the junction with the high side charge line, and to the vehicle's refrigerant system 200.

FIG. 2 also illustrates a vacuum pump oil drain circuitry 250 that includes a vacuum pump oil drain valve 252 that is located along a vacuum pump oil drain conduit 254 connecting a vacuum pump oil drain outlet 259 to the container 257 for containing the drained vacuum pump oil. The vacuum pump oil drain valve 252 may be an electronically activated solenoid valve controlled by controller 216. The connection may be a wireless or wired connection. In other embodiments the valve 252 may be a manually activated valve and manually actuated by a user. The conduit 254 may be a flexible hose or any other suitable conduit for provided fluid communication between the outlet 259 and the container 257.

FIG. 2 also illustrates an air purging apparatus 308. The air purging apparatus 308 allows the refrigerant recovery unit 100 to be purged of non-condensable, such as air. Air purged from the refrigerant recovery unit 100 may exit the storage tank 212, through an orifice 312, through a purging valve 314 and through an air diffuser 316. In some embodiments, the orifice may be 0.028 of an inch. A pressure transducer 310 may measure the pressure contained within the storage tank 212 and purge apparatus 308. The pressure transducer 310 may send the pressure information to the controller 216. Based upon the pressure information, the controller 216 may initiate purging if it is determined the pressure is too high, as calculated by the controller. The valve 314 may be selectively actuated to permit or not permit the purging apparatus 308 to be open to the ambient conditions. A temperature sensor 317 may be coupled to the main tank to measure the refrigerant temperature therein. The placement of the temperature sensor 317 may be anywhere on the tank or alternatively, the temperature sensor may be placed within a refrigerant line 322. The measured temperature and pressure may be used to calculate the ideal vapor pressure for the type of refrigerant used in the refrigerant recovery unit. The ideal vapor pressure can be used to determine when the non-condensable gases need to be purged and how much purging will be done in order for the refrigerant recovery unit to function properly.

High side clearing valves 318 may be used to clear out part of the high-pressure side of the system. The high side clearing valves 318 may include valve 323 and check valve 320. Valve 323 may be a solenoid valve. When it is desired to clear part of the high side, valve 323 is opened. Operation of the compressor 256 will force refrigerant out of the high pressure side through valves 323 and 320 and into the storage tank 212. During this procedure the normal discharge valve 284 may be closed.

A deep recovery valve 324 is provided to assist in the deep recovery of refrigerant. When the refrigerant from the refrigerant system 200 has, for the most part, entered into the refrigerant recovery unit 100, the remaining refrigerant may be extracted from the refrigerant system 200 by opening the deep recovery valve 324 and turning on the vacuum pump 258.

In another embodiment, in order to charge the refrigerant system 200, the power charge valve 326 may be opened and a tank fill structure 332 may be used. Alternatively or in addition to, the tank fill structure 332 may also be used to fill the storage tank 212. In order to obtain refrigerant from a refrigerant source, the refrigerant recovery unit 100 may include the tank fill structure 332, and valves 328 and 330. The tank fill structure 332 may be configured to attach to a refrigerant source. The valve 330 may be a solenoid valve and the valve 328 may be a check valve. In other embodiments, valve 330 may be a manually operated valve.

When it is desired to allow refrigerant from a refrigerant source to enter the refrigerant recovery unit 100, the tank fill structure 332 is attached to the refrigerant source and the tank fill valve 330 is opened. The check valve 328 prevents refrigerant from the refrigerant recovery unit 100 from flowing out of the refrigerant recovery unit 100 through the tank fill structure 332. When the tank fill structure 332 is not connected to a refrigerant source, the tank fill valve 330 is kept closed. The tank fill valve 330 may be connected to and controlled by the controller 216.

The tank fill structure 332 may be configured to be seated on the scale 334 configured to weigh the tank fill structure 332 in order to determine an amount of refrigerant stored in the tank fill structure 332. The scale 334 may be operatively coupled to the controller 216 and provide a measurement of a weight of the tank fill structure 332 to the controller 216. The controller 216 may cause a display of the weight of the tank fill structure 332 on the display 110.

Aspects of the refrigerant recovery unit 100 may be implemented via control system 400 using software or a combination of software and hardware. In one variation, aspects of the present invention may be directed toward a control system 400 capable of carrying out the functionality described herein. An example of such a control system 400 is shown in FIG. 3.

Figure 3:
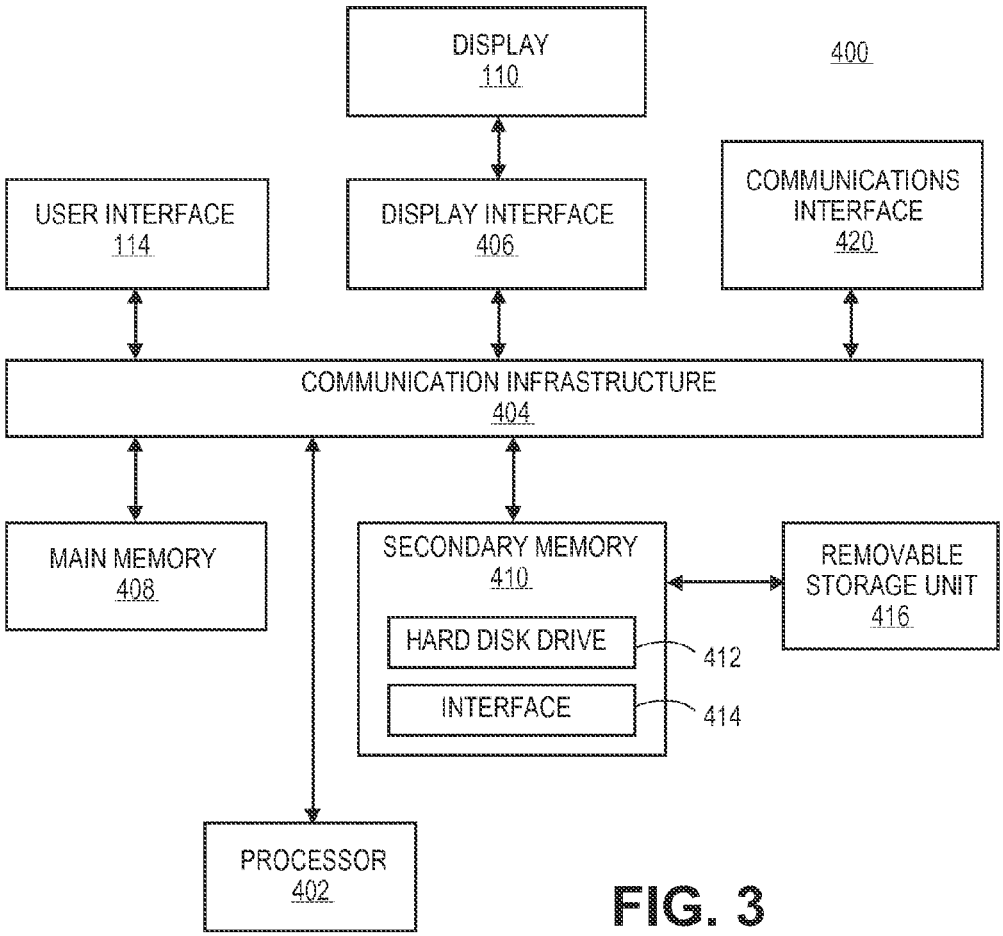
FIG. 3 is a block diagram illustrating aspects of a control system for the refrigerant recovery unit of FIG. 1.

FIG. 3 is a block diagram illustrating aspects of the control system 400 for the refrigerant recovery system 10 of FIG. 1. The control system 400 may be integrated with the controller 216 to permit, for example, automation of the recovery, evacuation, and recharging processes and/or manual control over one or more of each of the processes individually. In one embodiment, the control system 400 allows the refrigerant recovery unit to direct communicate and diagnose the vehicle under service. In another embodiment, the control system 400 allows for communication with a diagnostic tool, such as a vehicle communication interface (VCI), that is coupled to the vehicle under service. It should be understood that the VCI does not have to be coupled to a vehicle in order for the vehicle to communicate with the refrigerant recovery unit 100. This allows the refrigerant recovery unit 100 to receive information from the vehicle such as VIN (vehicle identification number), manufacturer, make, model, and odometer information, and vehicle sensor data that pertains to the heating, ventilation, and air conditioning sensors and systems on the vehicle. Data could include A/C and HVAC system sensor readings, A/C and HVAC related diagnostic trouble codes, system pressures, and interactive tests, like actuating of various components, such as a fan control. All of this data and information would be displayed on the display 110 of the refrigerant recovery unit 100. Menu selections, diagnostic trouble codes, and interactive tests may be displayed and certain diagnostic may be performed using the refrigerant recovery unit.

The control system 400 may also provide access to a configurable database of vehicle information so the specifications pertaining to a particular vehicle, for example, may be used to provide exacting control and maintenance of the functions described herein. The control system 400 may include a processor 402 connected to a communication infrastructure 404 (e.g., a communications bus, cross-over bar, or network). The various software and hardware features described herein are described in terms of an exemplary control system. A person skilled in the relevant art(s) will realize that other computer related systems and/or architectures may be used to implement the aspects of the disclosed invention.

The control system 400 may include a display interface 406 that forwards graphics, text, and other data from memory and/or the user interface 114, for example, via the communication infrastructure 404 for display on the display 110. The communication infrastructure 404 may include, for example, wires for the transfer of electrical, acoustic and/or optical signals between various components of the control system and/or other well-known means for providing communication between the various components of the control system, including wireless means. The control system 400 may include a main memory 408, random access memory (RAM), and may also include a secondary memory 410. The secondary memory 410 may include a hard disk drive 412 or other devices for allowing computer programs including diagnostic database (DTC information and repair and diagnostic information) or other instructions and/or data to be loaded into and/or transferred from the control system 400. Such other devices may include an interface 414 and a removable storage unit 416, including, for example, a Universal Serial Bus (USB) port and USB storage device, a program cartridge and cartridge interface (such as that found in video game devices), a removable memory chip (such as an erasable programmable read only memory (EPROM), or programmable read only memory (PROM)) and associated socket, and other removable storage units 416.

The control system 400 may also include a communications interface 420 for allowing software and data to be transferred between the control system 400 and external devices. Examples of a communication interfaces include a modem, a network interface (such as an Ethernet card), a communications port, wireless transmitter and receiver, BLUETOOTH®, near field communication (NFC), Wi-Fi, infra-red, cellular, satellite, a Personal Computer Memory Card International Association (PCMCIA) slot and card, etc.

The control system 400 also includes transceivers and signal translators necessary to communicate with the vehicle electronic control units in various communication protocols, such as J1850 (VPM and PWM), ISO 9141-2 signal, communication collision detection (CCD) (e.g., Chrysler collision detection), data communication links (DCL), serial communication interface (SCI), Controller Area Network (CAN), Keyword 2000 (ISO 14230-4), OBD II or other communication protocols that are implemented in a vehicle. This allows the refrigerant recovery unit to communicate directly with the vehicle without the VCI (e.g., directly connected to the vehicle) or while the VCI is simply acting as a pass through.

A software program (also referred to as computer control logic) may be stored in main memory 408 and/or secondary memory 410. Software programs may also be received through communications interface 420. Such software programs, when executed, enable the control system 400 to perform the features of the present invention, as discussed herein. In particular, the software programs, when executed, enable the processor 402 to perform the features of the present invention. Accordingly, such software programs may represent controllers of the control system 400.

In variations where the invention is implemented using software, the software may be stored in a computer program product and loaded into control system 400 using hard drive 412, removable storage drive 416, and/or the communications interface 420. The control logic (software), when executed by the processor 402, causes the controller 216, for example, to perform the functions of the invention as described herein. In another variation, aspects of the present invention can be implemented primarily in hardware using, for example, hardware components, such as application specific integrated circuits (ASICs), field programmable gate array (FPGA). Implementation of the hardware state machine so as to perform the functions described herein will be apparent to persons skilled in the relevant art(s).

Figure 4:
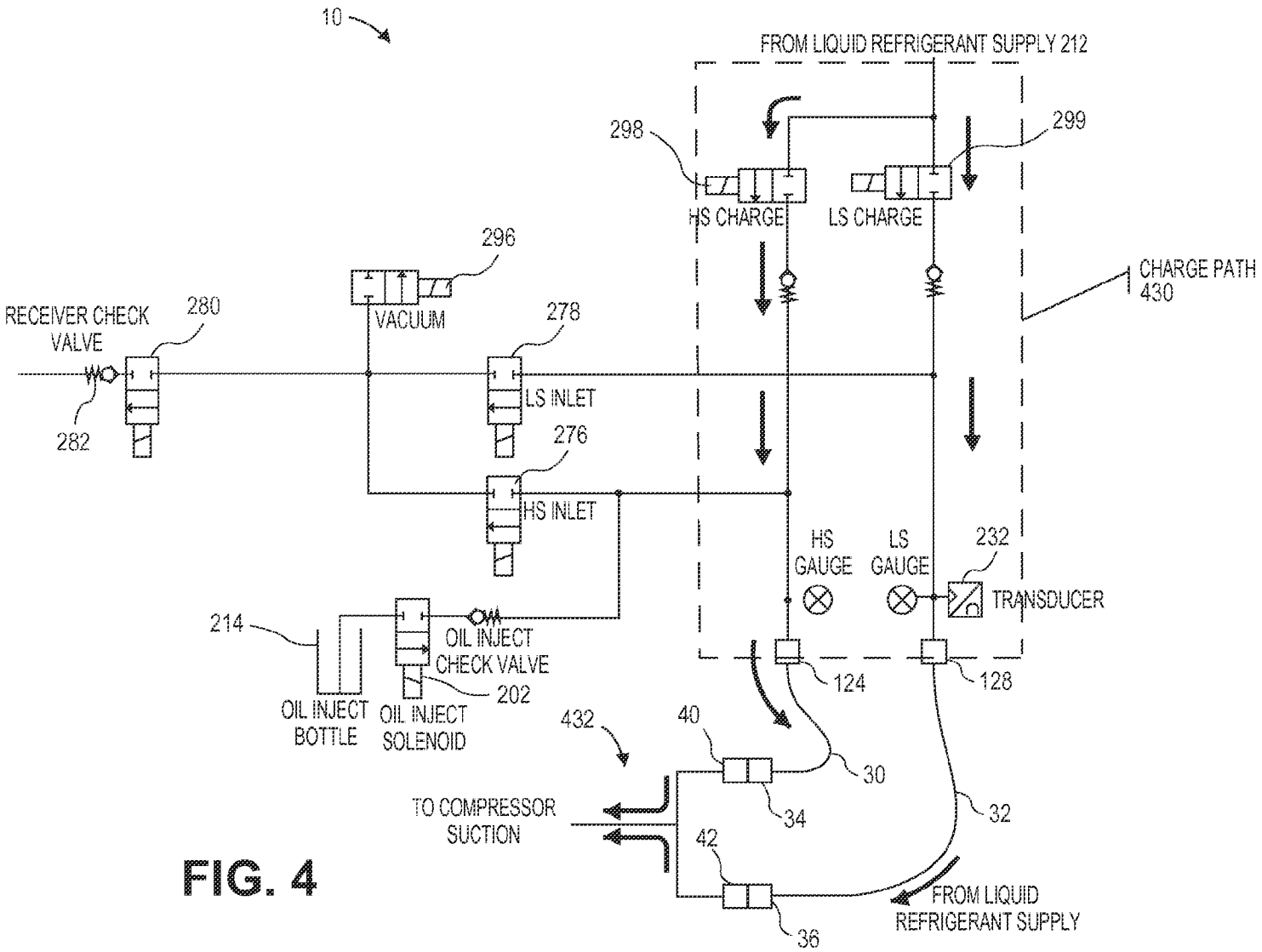
FIG. 4 is a schematic diagram illustrating components and modified flushing path suitable for use with the refrigerant recovery unit shown in FIG. 1.

FIG. 4 is a schematic diagram illustrating components and a flushing path 432 suitable for use with the refrigerant recovery system 10 shown in FIG. 1. FIG. 4 is similar to the schematic illustration of FIG. 2 and thus, in the interest of brevity, those items already described in FIG. 2 will not be described with reference to FIG. 4. As shown in FIG. 4, flow of refrigerant is directed from the refrigerant supply (such as the storage tank 212), out through the lines and the service hoses 30 and 32, and to the compressor suction (such as the vacuum pump 258). In this manner, refrigerant and lubricant from a serviced refrigeration system, such as the refrigeration system 200, is not drawn back through a portion of a charge path 430. It is an advantage to prevent the refrigerant and lubricant from the serviced refrigeration system 200 from being drawn back through the charge path 430 because of potential contaminants (such as water, for example) and the lubricant. These contaminants and the lubricant may be relatively difficult to clean from the lines so it is best to flush them directly out of the refrigerant recovery system 10 rather than flush the high side lines through the low side lines and vice versa as is done in conventional systems. The refrigerant used to flush the lines in the present example has been cleaned of moisture, filtered, and the lubricant removed. As such, the flushing refrigerant is capable of cleaning the lubricant and any contaminants from the lines and the service hoses 30 and 32. Following the flushing procedure, the charge valves 298 and 299 may be closed and the refrigerant used to flush the lines and the service hoses 30 and 32 may be removed via the compressor 256.

Figure 5:
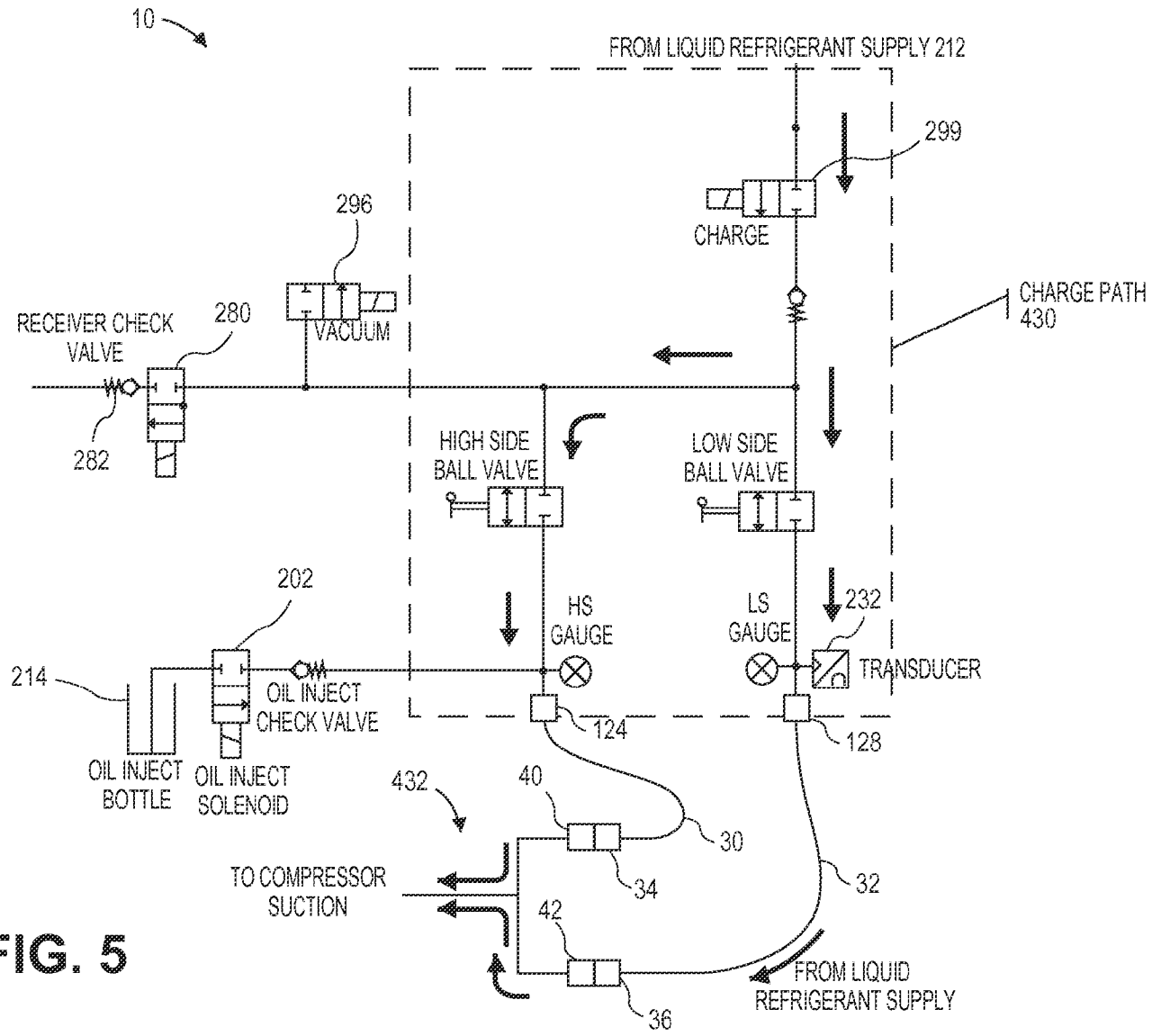
FIG. 5 is a schematic diagram illustrating other components and modified flushing path suitable for use with the refrigerant recovery unit shown in FIG. 1.

FIG. 5 is a schematic diagram illustrating other components and the flushing path 432 suitable for use with the refrigerant recovery system 10 shown in FIG. 1. FIG. 5 is similar to the schematic illustration of FIGS. 2 and 4 and thus, in the interest of brevity, those items already described in FIGS. 2 and 4 will not be described with reference to FIG. 5. As shown in FIG. 5, the refrigerant recovery system 10 has been simplified to reduce the number of valves. Specifically, the charge valve 298, the high pressure solenoid 276, and the low-pressure solenoid 278 may be omitted to reduce the complexity and/or cost of the refrigerant recovery system 10.

In this example, flow of refrigerant is directed from the refrigerant supply (such as the storage tank 212), out through the charge valve 299, conveyed through the lines and the service hoses 30 and 32, and to the compressor suction (such as the compressor 256). Following the flushing procedure, the charge valve 299 may be closed and the refrigerant used to flush the lines and the service hoses 30 and 32 may be removed via the vacuum pump 258.

It is to be understood that any feature described in relation to any one aspect may be used alone, or in combination with other features described, and may also be used in combination with one or more features of any other of the disclosed aspects, or any combination of any other of the disclosed aspects.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A refrigerant recovery system, comprising:

a refrigerant storage unit configured to store a refrigerant;

a refrigerant charge path configured to convey the refrigerant to a refrigeration system to recharge the refrigeration system with the refrigerant, the refrigerant charge path including:

a first service coupler disposed at a high side of the refrigeration charge path;

a first service hose in fluid communication with the first service coupler;

a second service coupler disposed at a low side of the refrigeration charge path; and a second service hose in fluid communication with the second service coupler;

a flushing path configured to receive a flow of refrigerant for flushing the refrigeration charge path, the flushing path including:

a first flushing coupler in fluid communication with the first service hose; and a second flushing coupler in fluid communication with the second service hose;

a processor configured to control the refrigerant recovery system to provide a flow of the refrigerant from the storage unit, through the refrigerant charge path, and to the flushing path, wherein the first flushing coupler and the second flushing coupler are in fluid communication with a vacuum source, and wherein the flow of the refrigerant from the first service hose is conveyed directly to the vacuum source without entering the second service hose and the flow of the refrigerant from the second service hose is conveyed directly to the vacuum source without entering the first service hose; and a memory to store diagnostic software and operating software to operate the refrigerant recovery system.

2. The refrigerant recovery system according to claim 1, wherein the refrigerant recovery system is configured to recover refrigerant from the refrigeration system.

3. The refrigerant recovery system according to claim 1, wherein the refrigerant storage unit is configured to supply the refrigerant to the refrigerant charge path and the refrigerant is substantially free of water and lubricant.

4. The refrigerant recovery system according to claim 1, further comprising:

an input interface configured to receive an input from a user; and a display configured to display information to the user.

5. The refrigerant recovery system according to claim 1, wherein the first service hose and the second service hose are configured to fluidly connect the refrigerant recovery system to the refrigeration system.

6. The refrigerant recovery system according to claim 1, wherein the refrigeration system is disposed in a vehicle.

7. A refrigerant recovery unit, comprising:

a refrigerant storage unit configured to store a refrigerant;

a refrigerant charge path configured to convey the refrigerant to a refrigeration system to recharge the refrigeration system with the refrigerant, the refrigerant charge path including:

a first service coupler disposed at a high side of the refrigeration charge path; and a second service coupler disposed at a low side of the refrigeration charge path;

a flushing path configured to receive a flow of refrigerant for flushing the refrigeration charge path, the flushing path including:

a first flushing coupler in fluid communication with the first service coupler; and a second flushing coupler in fluid communication with the second service coupler;

a processor configured to control the refrigerant recovery unit to provide a flow of the refrigerant from the storage unit, through the refrigerant charge path, and to the flushing path, wherein the first flushing coupler and the second flushing coupler are in fluid communication with a vacuum source, and wherein the flow of the refrigerant from a first service hose is conveyed directly to the vacuum source without entering a second service hose and the flow of the refrigerant from the second service hose is conveyed directly to the vacuum source without entering the first service hose; and a memory to store diagnostic software and operating software to operate the refrigerant recovery unit.

8. The refrigerant recovery unit according to claim 7, wherein the first service hose in fluid communication with the first service coupler and the first flushing coupler; and a second service hose in fluid communication with the second service coupler and the second flushing coupler.

9. The refrigerant recovery unit according to claim 8, wherein the first service hose and the second service hose are configured to fluidly connect the refrigerant recovery system to the refrigeration system.

10. The refrigerant recovery unit according to claim 7, wherein the refrigerant recovery unit is configured to recover refrigerant from the refrigeration system.

11. The refrigerant recovery unit according to claim 7, wherein the refrigerant storage unit is configured to supply the refrigerant to the refrigerant charge path and the refrigerant is substantially free of water and lubricant.

12. The refrigerant recovery unit according to claim 7, further comprising:

an input interface configured to receive an input from a user; and a display configured to display information to the user.

13. A refrigerant recovery unit, comprising:

a refrigerant storage unit configured to store a refrigerant;

a refrigerant charge path configured to convey the refrigerant to a refrigeration system to recharge the refrigeration system with the refrigerant, the refrigerant charge path including:

a single controllable valve disposed between the refrigerant storage unit and the refrigerant charge path;

a first service coupler disposed at a high side of the refrigerant charge path; and a second service coupler disposed at a low side of the refrigerant charge path;

a flushing path configured to receive a flow of refrigerant for flushing the refrigerant charge path, the flushing path including:

a first flushing coupler in fluid communication with the first service coupler; and a second flushing coupler in fluid communication with the second service coupler;

a processor configured to control the single controllable valve to provide a flow of the refrigerant from the storage unit, through the refrigerant charge path, and to the flushing path, wherein the first flushing coupler and the second flushing coupler are in fluid communication with a vacuum source, and wherein the flow of the refrigerant from a first service hose is conveyed directly to the vacuum source without entering a second service hose and the flow of the refrigerant from a second service hose is conveyed directly to the vacuum source without entering the first service hose; and a memory to store diagnostic software and operating software to operate the refrigerant recovery unit.

14. A method of flushing a refrigeration recovery system, the method comprising the stems of:

fluidly connecting a refrigerant charge path to a first service hose;

fluidly connecting the refrigerant charge path to a second service hose;

fluidly connecting the first service hose to a first flushing coupler of a flushing path;

fluidly connecting the second service hose to a second flushing coupler of the flushing path;

controlling a valve with a processor in the refrigerant recovery system to provide a flow of a refrigerant to flush the charge path, the first service hose, and the second service hose, wherein the first flushing coupler and the second flushing coupler are in fluid communication with a vacuum source and wherein the flow of the refrigerant from the first service hose is conveyed directly to the vacuum source without entering the second service hose and the flow of the refrigerant from the second service hose is conveyed directly to the vacuum source without entering the first service hose; and collecting the refrigerant from the flushing path in the refrigerant recovery system.

15. The method according to claim 14, further comprising the step of:

drawing the refrigerant through the flushing path with the vacuum source.

16. The method according to claim 15, further comprising the step of:

controlling the valve to stop the flow of the refrigerant.

17. The method according to claim 16, further comprising the step of:

continuing to draw the refrigerant through the flushing path in response to the valve being controlled to stop the flow of refrigerant.

18. The method according to claim 14, further comprising the step of:

flushing the first service hose and the second service hose in response to recharging the refrigeration system.

* * * * *